US009037021B2

(12) United States Patent
Yamaura et al.

(10) Patent No.: US 9,037,021 B2
(45) Date of Patent: May 19, 2015

(54) IMAGE FORMING APPARATUS INCLUDING A CLEANING-BIAS CONTROLLER

(71) Applicant: FUJI XEROX Co., Ltd., Minato-ku, Tokyo (JP)

(72) Inventors: Masaaki Yamaura, Kanagawa (JP); Masaya Nakatsuhara, Kanagawa (JP); Sho Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/962,100

(22) Filed: Aug. 8, 2013

(65) Prior Publication Data

US 2014/0119759 A1 May 1, 2014

(30) Foreign Application Priority Data

Oct. 25, 2012 (JP) ..... 2012-235480

(51) Int. Cl.
*G03G 15/00* (2006.01)
*G03G 15/16* (2006.01)

(52) U.S. Cl.
CPC ..... *G03G 15/168* (2013.01); *G03G 2215/0129* (2013.01); *G03G 2215/1661* (2013.01)

(58) Field of Classification Search
USPC ..... 399/66, 71, 101, 297, 302, 308, 314, 399/397
See application file for complete search history.

(56) References Cited

U.S. PATENT DOCUMENTS

| | | | | |
|---|---|---|---|---|
| 7,251,430 | B2 * | 7/2007 | Nishikawa | 399/71 |
| 7,440,711 | B2 * | 10/2008 | Kishi et al. | 399/101 |
| 7,949,269 | B2 * | 5/2011 | Takeuchi | 399/46 |
| 8,180,265 | B2 * | 5/2012 | Takishita | 399/297 |
| 2003/0053813 | A1 * | 3/2003 | Kida | 399/49 |
| 2012/0315055 | A1 * | 12/2012 | Zaima | 399/49 |
| 2013/0051832 | A1 * | 2/2013 | Aiba | 399/71 |

FOREIGN PATENT DOCUMENTS

| | | | |
|---|---|---|---|
| JP | 2008-089657 | A | 4/2008 |
| JP | 2011-248128 | A | 12/2011 |

* cited by examiner

*Primary Examiner* — Francis Gray
(74) *Attorney, Agent, or Firm* — Sughrue Mion, PLLC

(57) ABSTRACT

An image forming apparatus includes an image bearing member that bears a toner image; a transfer member that faces the image bearing member, nips a recording medium together with the image bearing member, and allows the recording medium to pass therebetween; a transfer-bias applying unit that applies transfer bias voltage to generate an electric field between the transfer member and the image bearing member; a cleaning member that is disposed in contact with the transfer member and removes toner from the transfer member; a cleaning-bias applying unit that applies cleaning bias voltage between the cleaning member and the transfer member; a transfer-toner-amount estimating unit that estimates an amount of toner to be transferred from the image bearing member to the transfer member when the recording medium does not pass therebetween; and a cleaning-bias controller that controls the cleaning bias voltage in correspondence with the estimated amount of toner.

11 Claims, 7 Drawing Sheets

IMAGE FORMING APPARATUS INCLUDING A CLEANING-BIAS CONTROLLER

CROSS-REFERENCE TO RELATED APPLICATIONS

This application is based on and claims priority under 35 USC 119 from Japanese Patent Application No. 2012-235480 filed Oct. 25, 2012.

BACKGROUND

Technical Field

The present invention relates to image forming apparatuses.

SUMMARY

According to an aspect of the invention, there is provided an image forming apparatus including an image bearing member, a transfer member, a transfer-bias applying unit, a cleaning member, a cleaning-bias applying unit, a transfer-toner-amount estimating unit, and a cleaning-bias controller. The image bearing member bears a toner image. The transfer member has a rotatable endless peripheral surface disposed facing the image bearing member, nips a recording medium together with the image bearing member, and allows the recording medium to pass between the transfer member and the image bearing member. The transfer-bias applying unit applies transfer bias voltage so that an electric field for transferring the toner image is generated between the transfer member and the image bearing member. The cleaning member is disposed in contact with the peripheral surface of the transfer member and removes toner adhered to the surface of the transfer member. The cleaning-bias applying unit applies cleaning bias voltage between the cleaning member and the transfer member. The transfer-toner-amount estimating unit estimates an amount of toner to be transferred from the image bearing member to the transfer member when the recording medium does not pass between the image bearing member and the transfer member. The cleaning-bias controller controls the cleaning bias voltage to be applied by the cleaning-bias applying unit in correspondence with the amount of toner estimated by the transfer-toner-amount estimating unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

Figure 1:
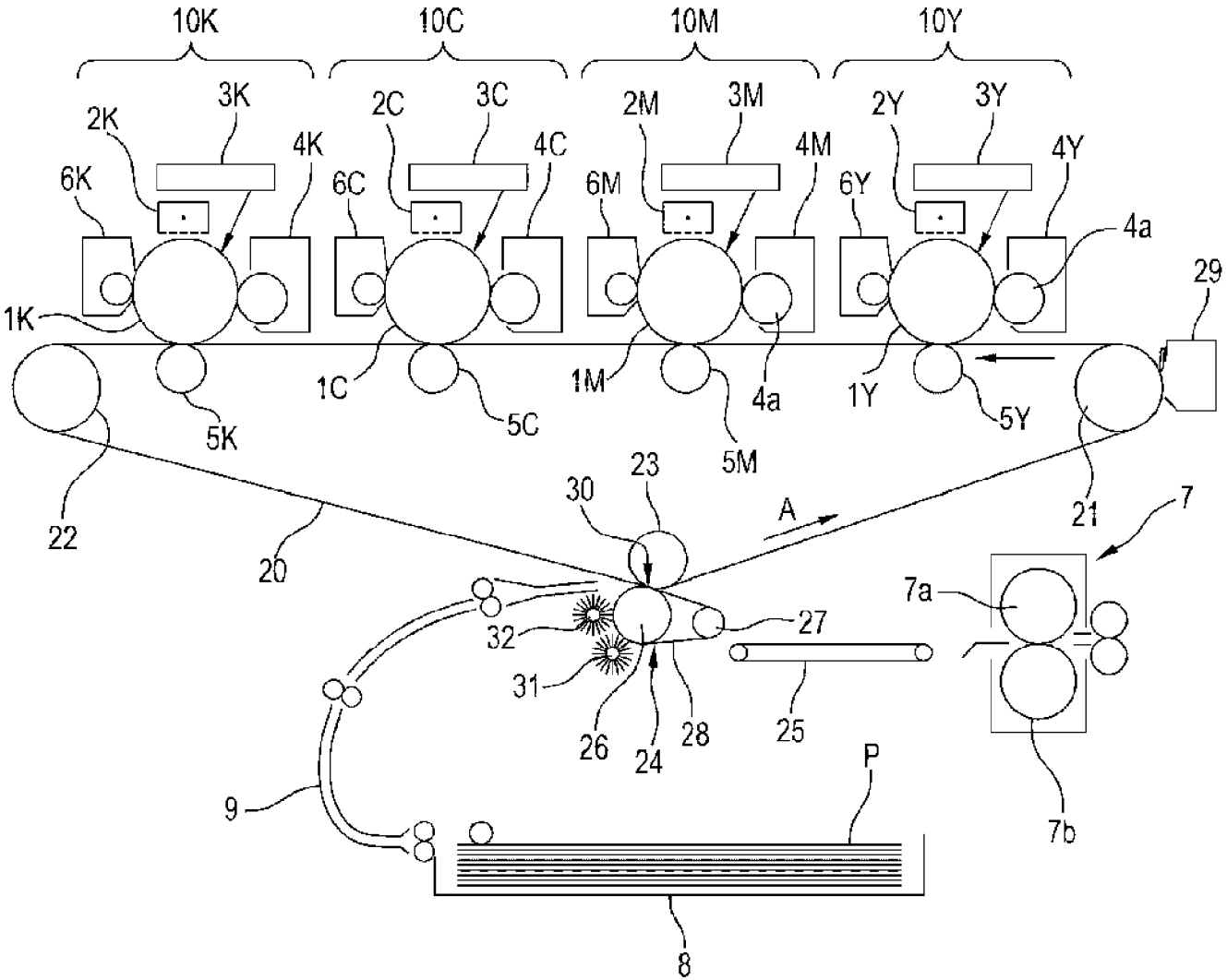
FIG. 1 schematically illustrates the configuration of an image forming apparatus according to an exemplary embodiment of the present invention.
Figure 2:
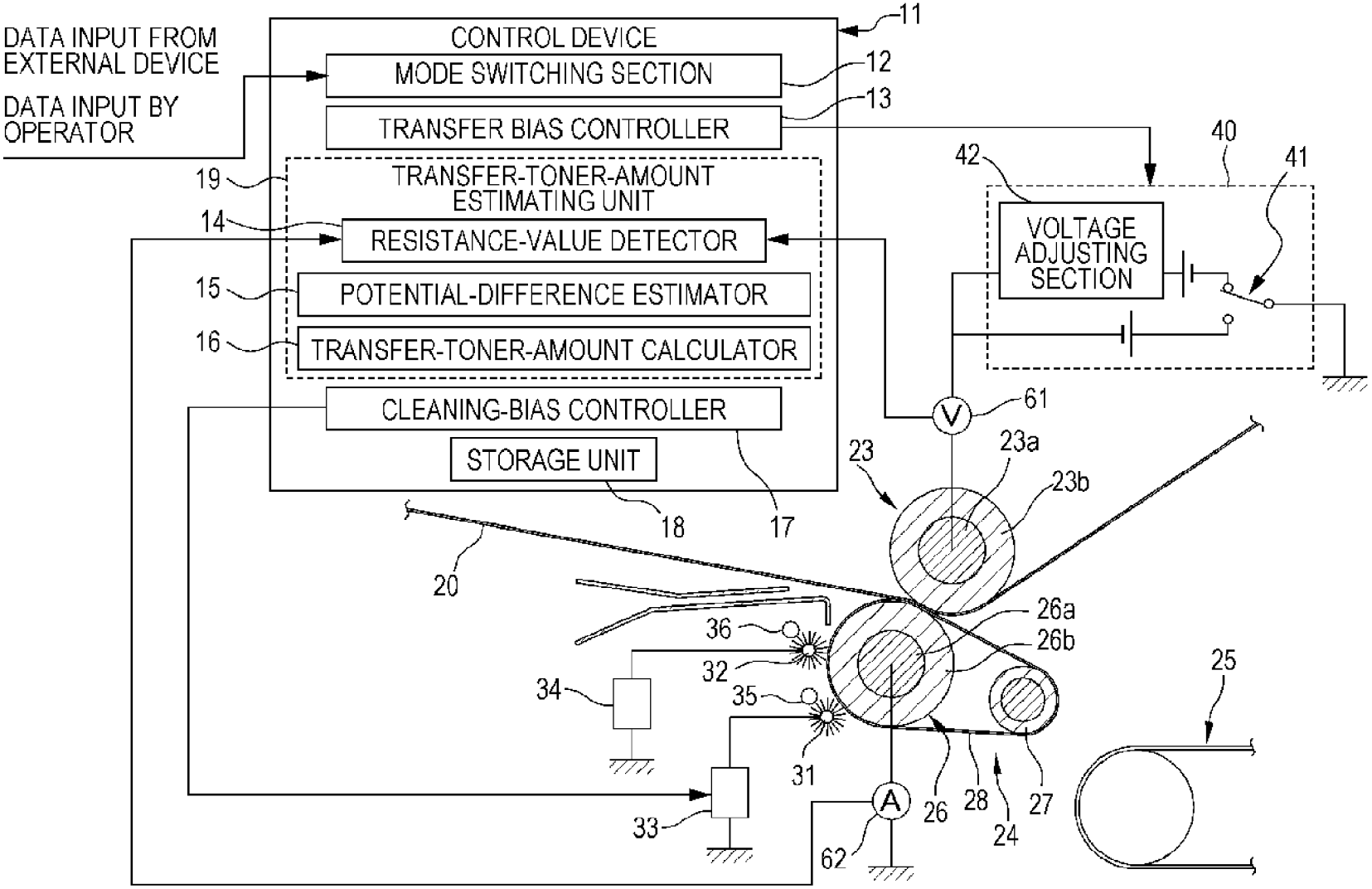
FIG. 2 schematically illustrates the configuration of an area surrounding a second-transfer position in the image forming apparatus shown in FIG. 1 and the configuration that controls bias voltage to be applied to second-transfer-member cleaning members.

FIG. 1 schematically illustrates the configuration of an image forming apparatus according to an exemplary embodiment of the present invention. FIG. 2 illustrates the configuration of an area surrounding a position where a second-transfer process is performed in the image forming apparatus shown in FIG. 1 and the configuration that controls bias voltage to be applied to second-transfer-member cleaning members.

The image forming apparatus forms a color image by using toners of four colors and includes electrophotographic image forming units 10Y, 10M, 10C, and 10K that respectively output yellow (Y), magenta (M), cyan (C), and black (K) images, and an intermediate transfer belt 20 that faces these image forming units 10Y, 10M, 10C, and 10K. The intermediate transfer belt 20 is extended so as to face the image forming units 10, and is driven such that a peripheral surface of the intermediate transfer belt 20 moves in a rotating manner. A second-transfer member 24 that performs a second-transfer process is disposed facing the intermediate transfer belt 20 at the downstream side, in the rotating direction of the intermediate transfer belt 20, of a position where the intermediate transfer belt 20 faces the image forming units 10. The second-transfer member 24 functions as a transfer member according to an exemplary embodiment of the present invention. A recording medium in the form of a sheet travels along a transport path 9 from a sheet accommodation section 8 so as to be fed to a second-transfer position 30 where the second-transfer member 24 faces the intermediate transfer belt 20, whereby a toner image on the intermediate transfer belt 20 is transferred onto the recording medium. A transport device 25 for the recording medium having the toner image transferred thereon and a fixing device 7 that heats and presses the toner image so as to fix the toner image onto the recording medium are provided at the downstream side of the second-transfer position 30 in a recording-medium transport path. An output-sheet load section (not shown) onto which a stack of recording media with fixed toner images are loaded is provided further downstream.

An intermediate-transfer-belt cleaning device 29 that collects residual toner from the intermediate transfer belt 20 after the second-transfer process is provided at the downstream side of the second-transfer position 30 in the rotating direction of the intermediate transfer belt 20. Furthermore, second-transfer-member cleaning members 31 and 32 that collect the toner transferred from the intermediate transfer belt 20 to the second-transfer member 24 at the second-transfer position 30 are disposed at positions facing an endless peripheral surface of the second-transfer member 24.

The image forming units 10 include the image forming unit 10Y that forms a yellow toner image, the image forming unit 10M that forms a magenta toner image, the image forming unit 10C that forms a cyan toner image, and the image forming unit 10K that forms a black toner image, which are arranged in that order from the upstream side in the rotating direction of the intermediate transfer belt 20. Each image forming unit 10 has a photoconductor drum 1 having a surface onto which an electrostatic latent image is formed. Each photoconductor drum 1 is surrounded by a charging device 2 that electrostatically charges the surface of the photoconductor drum 1, a developing device 4 that selectively transfers toner onto the latent image formed on the photoconductor drum 1 so as to form a toner image, a first-transfer roller 5 that first-transfers the toner image on the photoconductor drum 1 onto the intermediate transfer belt 20, and a photoconductor-drum cleaning device 6 that removes residual toner from the photoconductor drum 1 after the transfer process. Each photoconductor drum 1 is provided with an exposure device 3 that generates image light on the basis of an image signal and that radiates the image light onto the photoconductor drum 1 at the upstream side of a position facing the developing device 4 so as to write an electrostatic latent image onto the photoconductor drum 1.

Each photoconductor drum 1 is formed by stacking an organic photoconductor layer over a peripheral surface of a metallic cylindrical member, and the metallic portion is electrically grounded. Furthermore, each photoconductor drum 1 may be of a type that receives bias voltage.

Each charging device 2 includes an electrode wire extended with a certain distance from the peripheral surface of the corresponding photoconductor drum 1, which is an electrostatically charged member. By applying voltage between the electrode wire and the photoconductor drum 1, corona discharge is generated, thereby electrostatically charging the surface of the photoconductor drum 1.

Although a charging device based on corona discharge is used in this exemplary embodiment, as described above, a solid discharge device or a contact-type or non-contact-type charging device in the form of a roller or a blade may be used as an alternative.

Each exposure device 3 generates blinking laser light on the basis of an image signal and scans the laser light in a scanning direction (i.e., axial direction) of the corresponding photoconductor drum 1 by using a polygonal mirror (not shown). Thus, an electrostatic latent image corresponding to an image of the corresponding color is formed on the surface of the photoconductor drum 1.

Each developing device 4 uses a two-component developer containing a toner and a magnetic carrier and includes a rotatable developing roller 4*a* disposed at a position facing the corresponding photoconductor drum 1. A layer of the two-component developer is formed over the peripheral surface of the developing roller 4*a*. By transferring a negatively charged toner from the peripheral surface of the developing roller 4*a* onto the photoconductor drum 1, the electrostatic latent image is made into a visible image. After the toner is consumed as the result of the image forming process, fresh toner is supplied in accordance with the consumed amount of toner.

The first-transfer rollers 5 are disposed at the underside of the intermediate transfer belt 20 at positions facing the photoconductor drums 1Y, 1M, 1C, and 1K in the image forming units 10Y, 10M, 10C, and 10K. Transfer bias voltage is applied between the first-transfer rollers 5Y, 5M, 5C, and 5K and the photoconductor drums 1Y, 1M, 1C, and 1K, so that the toner images on the photoconductor drums 1 are transferred onto the rotating intermediate transfer belt 20 at first-transfer positions where the first-transfer rollers 5 and the photoconductor drums 1 face each other.

Each photoconductor-drum cleaning device 6 has a cleaning blade disposed in contact with the peripheral surface of the corresponding photoconductor drum 1 and uses the cleaning blade to remove residual toner from the photoconductor drum 1 after the transfer process.

The intermediate transfer belt 20 is formed of an endless multilayer film member. The intermediate transfer belt 20 functions as an image bearing member according to an exemplary embodiment of the present invention. The intermediate transfer belt 20 is wrapped around a rotationally-driven drive roller 21, an adjustment roller 22 that adjusts deviation of the intermediate transfer belt 20 in the width direction thereof, and an opposed roller 23 supported at a position facing the second-transfer member 24, and rotates in a direction indicated by an arrow A in FIG. 1.

The second-transfer member 24 disposed facing the opposed roller 23 with the intermediate transfer belt 20 interposed therebetween has a second-transfer roller 26, an auxiliary roller 27, and a second-transfer belt 28 wrapped around these rollers. The second-transfer belt 28 is nipped between the opposed roller 23 and the second-transfer roller 26 in a state where the second-transfer belt 28 overlaps the intermediate transfer belt 20, and is rotated by the rotation of the intermediate transfer belt 20. When a recording medium is fed into between the intermediate transfer belt 20 and the second-transfer belt 28, the intermediate transfer belt 20 and the second-transfer belt 28 nip and transport the recording medium.

The second-transfer roller 26 is formed by coating an outer peripheral surface of a metallic core 26*a* with an outer peripheral layer 26*b* composed of rubber with conductive particles added thereto. The opposed roller 23 is formed by coating an outer peripheral surface of a metallic core 23*a* with an outer peripheral layer 23*b*. The outer peripheral layer 23*b* may be a single layer or may be formed of multiple layers.

Referring to FIG. 2, transfer bias voltage is applied between the second-transfer roller 26 and the opposed roller 23 from a transfer-bias power supply device 40 functioning as a transfer-bias applying unit, whereby a transfer electric field is generated at the second-transfer position 30. The transfer-bias power supply device 40 includes a switch 41 that switches between a first bias voltage value for applying a negative potential to the opposed roller 23 and a second bias voltage value for applying a positive potential to the opposed roller 23. Thus, the transfer-bias power supply device 40 is capable of applying voltage between the opposed roller 23 and the second-transfer roller 26 by switching the polarity of the applied voltage. When a negative potential is to be applied, that is, when transfer bias voltage for transferring the toner image from the intermediate transfer belt 20 is to be applied, the voltage value may be adjusted by a voltage adjusting section 42. The voltage value may be adjusted by the voltage adjusting section 42 in accordance with an environmental change, such as a change in the temperature or humidity. For example, the adjustment may be performed in a range between −3 kV and −12 kV. When a positive potential is to be applied to the opposed roller 23, the voltage value may be set to, for example, +1 kV. In this case, a fixed potential may be constantly applied, or the voltage value may be varied in accordance with an environmental change, such as a change in the temperature or humidity.

The second bias voltage value may be a value that sets the opposed roller 23 to a zero potential, that is, a value that sets the voltage application in an OFF state.

The switching of the voltage value to be applied as the aforementioned transfer bias voltage and the voltage adjustment performed by the voltage adjusting section 42 are controlled by a transfer bias controller 13 of a control device 11. Specifically, the transfer bias controller 13 of the control device 11 and the switch 41 of the power supply device 40 function as a bias switching unit.

The switching between the first bias voltage value and the second bias voltage value to be applied to the opposed roller 23 is performed in correspondence with a timing at which the toner image on the intermediate transfer belt 20 passes through the second-transfer position 30. Specifically, when a toner image to be transferred onto a recording medium passes through the second-transfer position 30, a negative potential is applied to the opposed roller 23 so that a negatively charged toner is transferred onto the recording medium. When a non-transfer image that is not to be transferred onto a recording medium, such as a density-adjustment test image formed between an image to be transferred onto a recording medium and a subsequent transfer image, or a line image used for adjusting an image formation position, passes through the second-transfer position 30, a positive potential is applied to the opposed roller 23 so that a negatively charged toner is not transferred onto the second-transfer member 24.

The fixing device 7 is configured to fix the toner image onto the recording medium by heating and pressing the recording medium having the toner image transferred thereon at the second-transfer position 30, and includes a heating roller 7*a* having a built-in heating source and a pressing roller 7*b* that is in pressure contact with the heating roller 7*a*. The recording medium having the toner image transferred thereon is fed to a contact area between the rotationally driven heating roller 7*a* and pressing roller 7*b* so as to be heated and pressed by the two rollers, whereby the toner image becomes fixed onto the recording medium.

The intermediate-transfer-belt cleaning device 29 is configured to remove residual toner, such as the toner forming a non-transfer image held on the intermediate transfer belt 20 without being transferred at the second-transfer position 30 or the toner remaining on the intermediate transfer belt 20 after the toner image is transferred onto the recording medium, from the peripheral surface of the intermediate transfer belt 20, and includes a cleaning blade that is in contact with the peripheral surface of the intermediate transfer belt 20. By using this cleaning blade, the toner adhered on the peripheral surface of the intermediate transfer belt 20 is scraped off and removed therefrom.

The second-transfer-member cleaning members mentioned above include a first cleaning member 31 and a second cleaning member 32 that are disposed in contact with the peripheral surface of the second-transfer belt 28. Each of the cleaning members 31 and 32 is formed by attaching a brush radially around a metallic rotation shaft. The brush is composed of a resin material with conductive particles mixed therein. By applying voltage to the brush from the rotation shaft, an electric field is generated between the brush and the second-transfer roller 26. Specifically, a first cleaning-bias power source 33 applies cleaning bias voltage between the electrically-grounded second-transfer roller 26 and the first cleaning member 31 that is in contact with the upstream side of the second-transfer belt 28 in the rotating direction thereof, so that a positive potential is applied to the first cleaning member 31. A second cleaning-bias power source 34 applies cleaning bias voltage between the second-transfer roller 26 and the second cleaning member 32 that is in contact with the downstream side of the second-transfer belt 28, so that a negative potential is applied to the second cleaning member 32. Therefore, the first cleaning member 31 supplied with bias voltage that gives the first cleaning member 31 a positive polarity removes a negatively charged toner from the peripheral surface of the second-transfer belt 28, and the second cleaning member 32 supplied with voltage that gives the second cleaning member 32 a negative polarity removes a positively charged toner from the peripheral surface of the second-transfer belt 28.

Reference numerals 35 and 36 shown in FIG. 2 denote scraping members that come into contact with the brushes of the first cleaning member 31 and the second cleaning member 32 so as to scrape off the toner that has been removed from the peripheral surface of the second-transfer belt 28.

The first cleaning member 31 functions as a cleaning member according to an exemplary embodiment of the present invention. The voltage value of the cleaning bias voltage applied to the first cleaning member 31 is controlled by the control device 11. The control device 11 includes a resistance-value detector 14 that detects a resistance value between the opposed roller 23 and the second-transfer roller 26, a potential-difference estimator 15 that estimates a potential difference between the surface of the intermediate transfer belt 20 and the surface of the second-transfer belt 28 when a non-transfer image enters the second-transfer position 30, and a transfer-toner-amount calculator 16 that calculates an amount of toner to be transferred onto the second-transfer belt 28 from the non-transfer image. The resistance-value detector 14, the potential-difference estimator 15, and the transfer-toner-amount calculator 16 function as a transfer-toner-amount estimating unit 19. Based on the transfer-toner amount estimated by the transfer-toner-amount estimating unit 19 or data associated with the transfer-toner amount, a cleaning-bias controller 17 functioning as a cleaning-bias controller according to an exemplary embodiment of the present invention controls the cleaning bias voltage to be applied to the first cleaning member 31 from the first cleaning-bias power source 33 functioning as a cleaning-bias applying unit.

In addition to having the function of controlling the application of the aforementioned transfer bias voltage, the function of estimating the amount of toner to be transferred onto the second-transfer belt 28 from the intermediate transfer belt 20, and the function of controlling the cleaning bias voltage to be applied to the first cleaning member 31, the control device 11 functions as a mode switching unit.

A mode switching section 12 functioning as a mode switching unit is configured to selectively switch between a bias control mode in which the cleaning bias voltage to be applied to the first cleaning member 31 is controlled on the basis of the estimated amount of toner to be transferred onto the second-transfer member 24 and a constant bias mode in which a predetermined bias voltage value is applied between the first cleaning member 31 and the second-transfer roller 26. The bias control mode is selected when the back face of the recording medium is dirty and has to be cleaned by the second-transfer belt 28, which will be described later. The constant bias mode is selected when, for example, there is a low possibility that the back face of the recording medium may become dirty or when dirtiness of the back face is negligible.

In the constant bias mode, the control of the cleaning bias voltage based on the amount of toner to be transferred onto the second-transfer member 24 is not performed. Instead, in this mode, a predetermined bias voltage value is applied to the first cleaning member 31 so that the bias voltage is controlled to the predetermined bias voltage value in correspondence with the temperature and humidity.

In the bias control mode, the transfer-toner-amount estimating unit 19 estimates the amount of toner to be transferred onto the peripheral surface of the second-transfer belt 28 from the non-transfer image on the intermediate transfer belt 20. Based on this estimated amount, the cleaning-bias controller 17 controls a voltage value to be applied to the first cleaning member 31 from the first cleaning-bias power source 33.

The reason for controlling the cleaning bias voltage on the basis of the amount of toner to be transferred onto the second-transfer belt 28 from the non-transfer image on the intermediate transfer belt 20 will be described below.

Figure 3A:
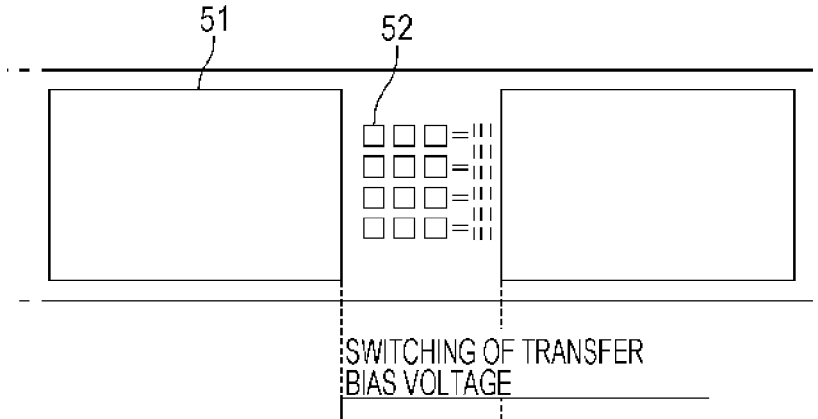
FIGS. 3A to 3C schematically illustrate switching of transfer bias voltage to be applied between a second-transfer member and an opposed roller at the second-transfer position and a change in a potential difference between the second-transfer member and the opposed roller.
Figure 3B:
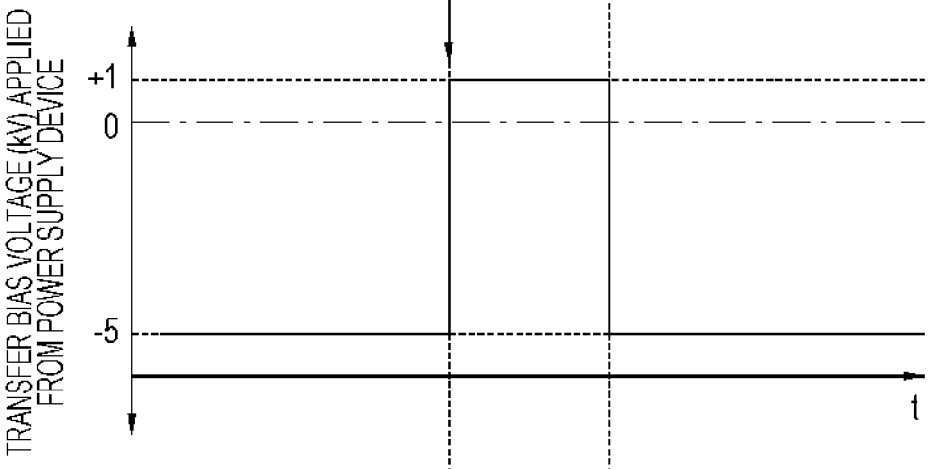

Referring to FIG. 3B, second-transfer bias voltage to be applied between the second-transfer belt 28 and the opposed roller 23 is switched by the switch 41 between when a transfer image 51 to be transferred onto the recording medium passes through the second-transfer position 30 and when a non-transfer image 52 not to be transferred onto the recording medium passes through the second-transfer position 30 based on a signal from the transfer bias controller 13. In this exemplary embodiment, when the transfer image 51 passes through the second-transfer position 30, the potential of the opposed roller 23 relative to the electrically-grounded second-transfer roller 26 is set to a first bias voltage value of, for example, −5 kV. When the non-transfer image 52 passes through the second-transfer position 30, the aforementioned potential is set to a second bias voltage value of, for example, +1 kV. The transfer bias voltage to be applied when the transfer image 51 passes through the second-transfer position 30 may be varied by the voltage adjusting section 42 in a range between, for example, −3 kV and −12 kV in accordance with a change in the temperature or humidity.

Figure 3C:
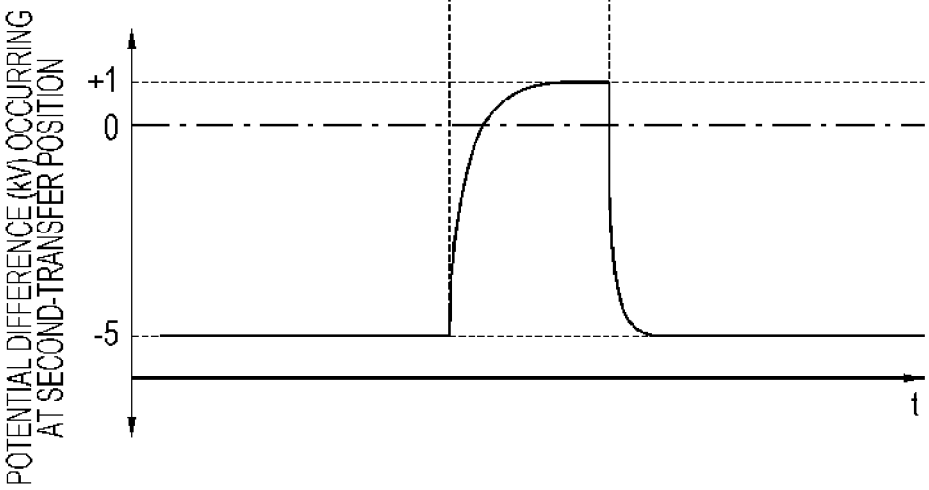
Figure 4:
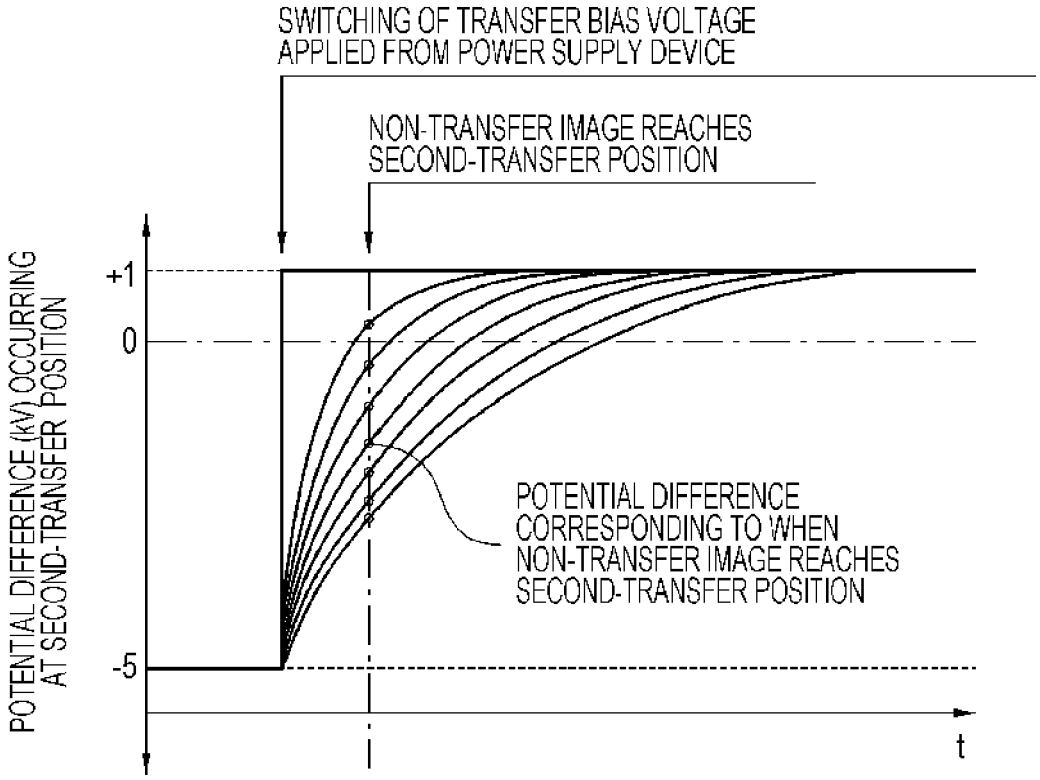
FIG. 4 schematically illustrates the relationship between a change in a time constant at the time of switching of the transfer bias voltage and the potential difference at the second-transfer position when a non-transfer image reaches the second-transfer position.

Referring to FIG. 3C, when the voltage is switched as in the above-described manner, there is an occurrence of a delay in a variation in the potential difference occurring between the surface of the second-transfer roller 26 and the surface of the opposed roller 23 from a time point at which the switching is performed in the power supply device 40. An indicator that indicates the degree of this delay, that is, a time constant, varies in accordance with a change in, for example, the temperature or humidity, as shown in FIG. 4. If the speed at which the recording medium passes through the second-transfer position 30 is high, the non-transfer image 52 enters the second-transfer position 30 during a period in which the potential difference between the surface of the second-transfer roller 26 and the surface of the opposed roller 23 varies due to the bias voltage being switched to +1 kV from the state where −5 kV is applied for transferring the transfer image 51. Toner is transferred from the leading edge of the non-transfer image 52 onto the peripheral surface of the second-transfer belt 28 on the basis of the potential difference corresponding to the time point at which the non-transfer image 52 reaches the second-transfer position 30. In other words, when the time constant varies due to a change in, for example, the temperature or humidity, the potential difference occurring when the non-transfer image 52 enters the second-transfer position 30 varies greatly, causing the amount of toner to be transferred onto the second-transfer belt 28 to vary greatly.

On the other hand, a cleaning bias voltage value suitable for removing the toner from the second-transfer belt 28 by using the first cleaning member 31 varies depending on the amount of toner held on the second-transfer belt 28.

Figure 5:
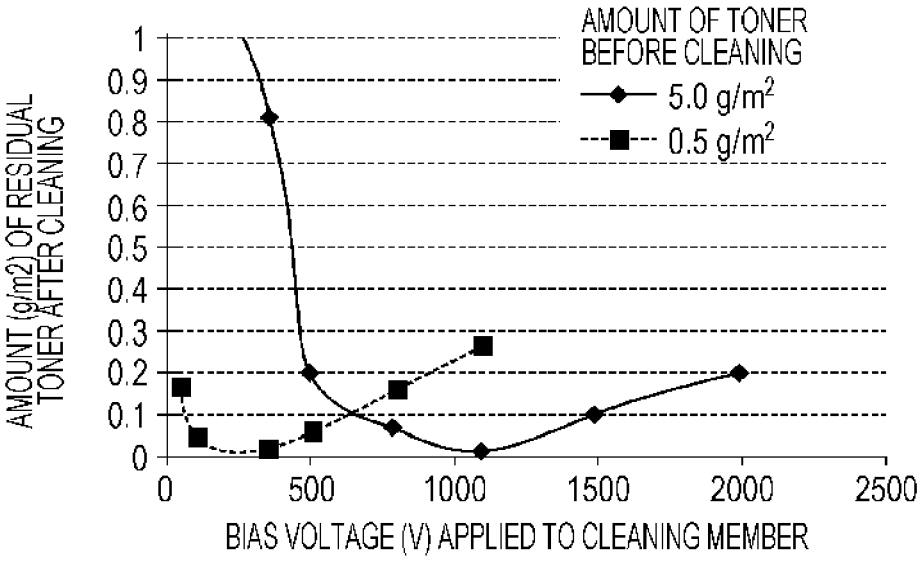
FIG. 5 illustrates the relationship between cleaning bias voltage to be applied to the second-transfer-member cleaning members and an amount of residual toner after the cleaning process in a case where the amount of toner adhered to the surface of the second-transfer belt varies.

FIG. 5 illustrates the relationship between the cleaning bias voltage applied to the first cleaning member 31 and an amount of residual toner not removed by the first cleaning member 31 and shows results of tests performed by varying the amount of toner held on the second-transfer belt 28 prior to the cleaning process.

The amount of residual toner decreases with increasing cleaning bias voltage value so that the cleaning efficiency is improved. However, as the bias voltage value is further increased, the amount of residual toner begins to increase. This is conceivably due to the fact that discharge occurs due to an increase in the bias voltage value, causing the cleaning efficiency to deteriorate without formation of an electric field. Therefore, the cleaning bias voltage value may be set within a range that allows for good cleaning efficiency. However, as shown in FIG. 5, when the amount of toner held on the second-transfer belt 28 changes, the bias-voltage-value range that allows for good cleaning efficiency varies greatly. This is conceivably due to the fact that, when the amount of toner held on the second-transfer belt 28 increases, the resistance value between the surface of the second-transfer belt 28 and the first cleaning member 31 increases, causing the cleaning bias voltage value that induces discharge to become larger than that when the amount of held toner is small.

Because the bias voltage value that allows for good cleaning efficiency varies in this manner, the cleaning bias voltage value to be applied to the first cleaning member 31 may be set to a large value when there is a large amount of toner adhered on the second-transfer belt 28, and the cleaning bias voltage value to be applied to the first cleaning member 31 may be set to a small value when there is a small amount of toner adhered on the second-transfer belt 28. In other words, by controlling the cleaning bias voltage value to be applied to the first cleaning member 31 on the basis of the amount of toner on the second-transfer belt 28, good cleaning efficiency may be maintained even when the amount of toner on the second-transfer belt 28 varies.

Therefore, the cleaning bias voltage value to be applied to the first cleaning member 31 is controlled in correspondence with the aforementioned variation in the amount of toner to be transferred onto the second-transfer belt 28 from the non-transfer image 52 after switching the transfer bias voltage.

The cleaning bias voltage value to be applied to the first cleaning member 31 is controlled in the following manner.

When a predetermined condition is satisfied, such as when the power of the image forming apparatus is turned on, when an image formable state is reached after a standby mode continues for a predetermined time or longer, or after an image forming operation is repeated for a predetermined number of sheets, the intermediate transfer belt 20 and the second-transfer belt 28 are driven, and transfer bias voltage is applied between the opposed roller 23 and the second-transfer roller 26. Then, in a state where a toner-image forming process is not performed and a recording medium is not fed to the second-transfer position 30, a resistance value between the opposed roller 23 and the second-transfer roller 26 is detected. The resistance-value detection may be performed by detecting a voltage value and an electric-current value by using a voltmeter 61 and an ammeter 62, respectively, when the transfer bias voltage is applied.

Figure 6:
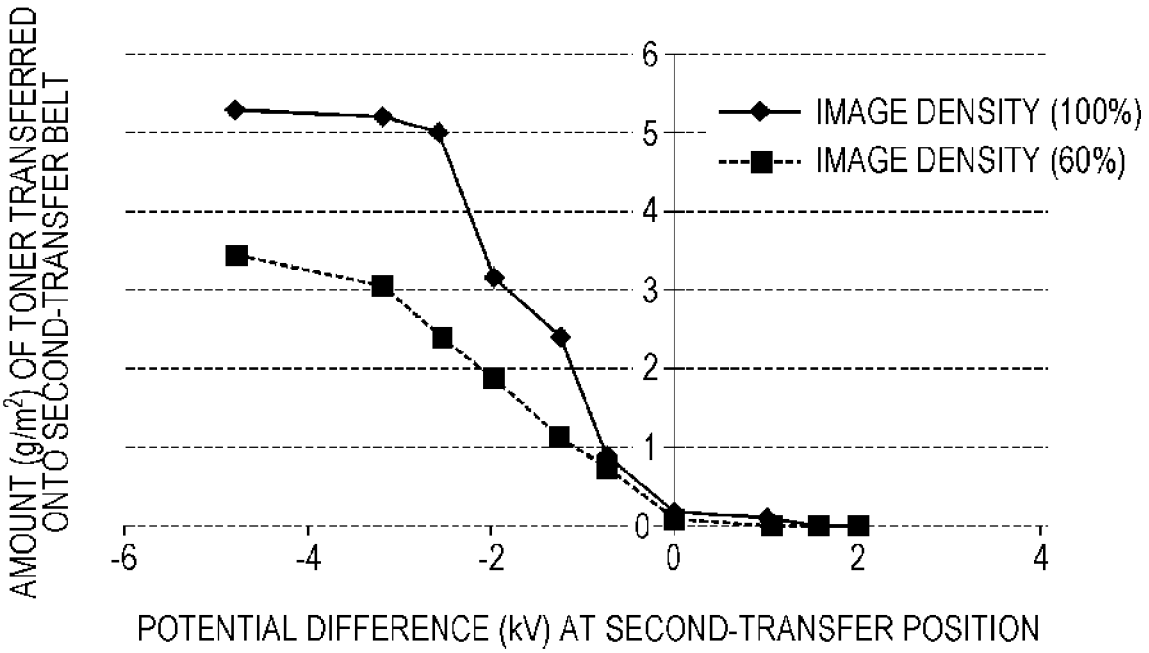
FIG. 6 illustrates the relationship between the potential difference at the second-transfer position and an amount of toner to be transferred onto the second-transfer belt.

After switching the transfer bias voltage, a time constant corresponding to a change in the potential difference occurring between the surface of the opposed roller 23 and the surface of the second-transfer roller 26 varies in accordance with the resistance value between the opposed roller 23 and the second-transfer roller 26 when the transfer bias voltage is applied. Therefore, by preliminarily examining data that specifies the relationship between the resistance value and the time constant, if this data is stored in a storage unit 18 serving as a memory according to an exemplary embodiment of the present invention, the time constant may be determined from the detected resistance value. The potential-difference estimator 15 may calculate and estimate a potential difference occurring at the second-transfer position 30 when the non-transfer image 52 enters the second-transfer position 30 from the aforementioned time constant and a timing at which the non-transfer image 52 enters the second-transfer position 30 after switching the transfer bias voltage. Furthermore, if the relationship between the aforementioned potential difference and the amount of toner to be transferred at the second-transfer position 30, such as data related to the transfer efficiency, is preliminarily examined and stored in the storage unit 18, the transfer-toner-amount calculator 16 may estimate the amount of toner to be transferred onto the second-transfer belt 28 from, for example, the aforementioned data and information related to the non-transfer image 52, such as the area percentage and the pattern of an image section. Furthermore, as shown in FIG. 6, by preliminarily examining the relationship between the potential difference occurring between the surface of the opposed roller 23 and the surface of the second-transfer roller 26 and the amount of toner to be transferred onto the second-transfer belt 28, the transfer-toner amount may be estimated from this data. The cleaning-bias controller 17 may control the cleaning bias voltage value to be applied to the first cleaning member 31 on the basis of the estimated transfer-toner amount.

Figure 7:
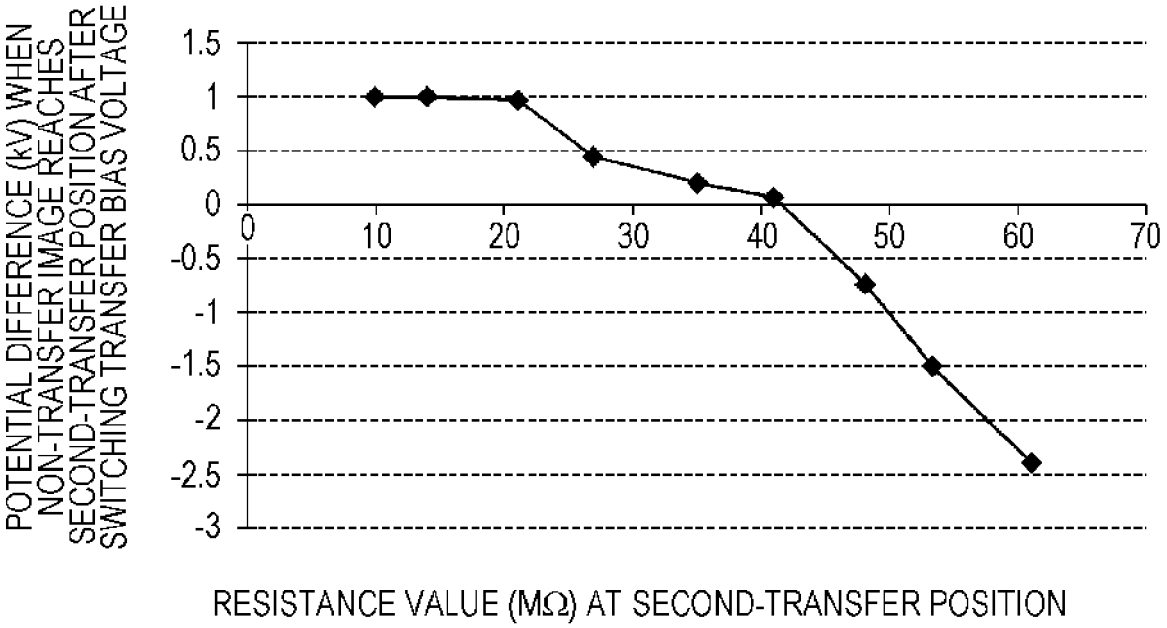
FIG. 7 illustrates an example of the relationship between a resistance value between the second-transfer member and the opposed roller and a potential difference occurring at the second-transfer position when a toner image enters the second-transfer position after switching the transfer bias voltage.

If the timing at which the non-transfer image 52 enters the second-transfer position 30 after switching the transfer bias voltage does not vary, the relationship between the resistance value and the potential difference occurring at the second-transfer position 30 may be preliminarily stored in the storage unit 18, as shown in FIG. 7, and a potential difference occurring when the non-transfer image 52 enters the second-transfer position 30 may be estimated from the detected resistance value, instead of performing a process of determining a time constant from a measured resistance value for every detection of a resistance value. Furthermore, if the non-transfer image 52 is limited to a single pattern, the amount of toner to be transferred onto the second-transfer belt 28 may be estimated from the potential difference at the second-transfer position 30. Therefore, the cleaning-bias controller 17 may control the cleaning bias voltage value on the basis of the relationship between the transfer-toner amount and the resistance value stored in the storage unit 18. Specifically, in this case, sections functioning as the potential-difference estimator 15 and the transfer-toner-amount calculator 16 are included in the data stored in the storage unit 18.

Accordingly, in the bias control mode, the process of detecting the resistance value between the opposed roller 23 and the second-transfer belt 28 is performed prior to the process of forming and transferring the toner image. However, when the driving speed of the intermediate transfer belt 20 is low to an extent that the cleaning bias voltage to be applied to the first cleaning member 31 is not to be controlled, as described above, an image forming operation can be performed in the constant bias mode without having to detect the resistance value. In other words, when the non-transfer image 52 enters the second-transfer position 30, the potential difference at the second-transfer position 30 after switching the transfer bias voltage has passed a transition period, and when the moving speed of the intermediate transfer belt 20 is low to an extent that the potential difference occurring between the surface of the opposed roller 23 and the surface of the second-transfer roller 26 is stable at a substantially fixed value, the above-described control is not performed. Moreover, even when an image to be transferred onto a recording medium is to be formed without forming the non-transfer image 52 to prioritize the image forming rate, the control of the cleaning bias voltage value based on the amount of toner to be transferred onto the second-transfer belt 28 is not performed, whereby the image forming operation can be performed in the constant bias mode.

Next, another exemplary embodiment of the present invention will be described.

Figure 8:
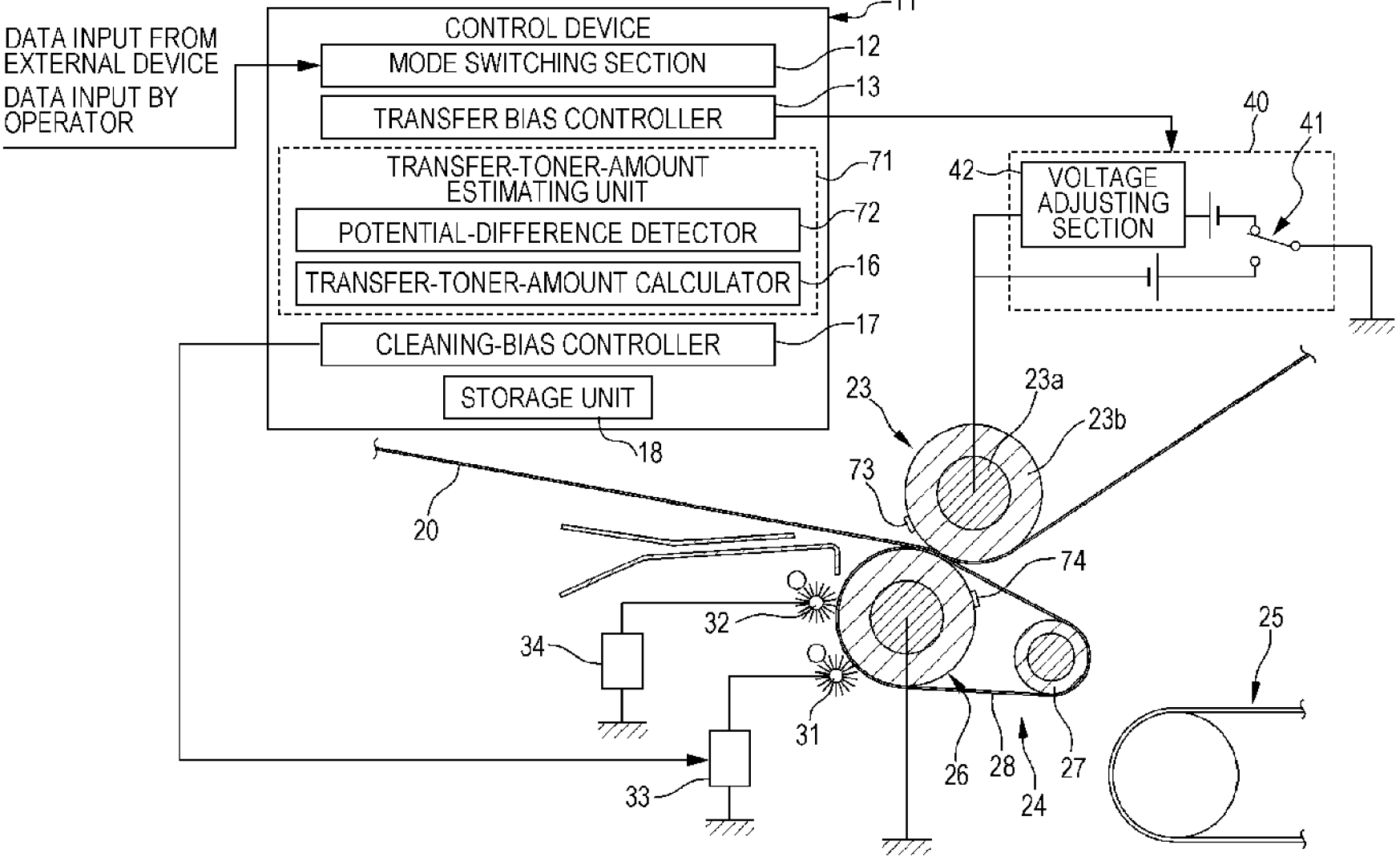
FIG. 8 schematically illustrates the configuration of an area surrounding the second-transfer position in an image forming apparatus according to another exemplary embodiment of the present invention and the configuration that controls bias voltage to be applied to the cleaning members.

FIG. 8 schematically illustrates the configuration of an image forming apparatus according to another exemplary embodiment of the present invention.

The image forming apparatus is different from the image forming apparatus shown in FIG. 2 in that a unit 71 functioning as a transfer-toner-amount estimating unit in the control device 11 includes a potential-difference detector 72 in place of the resistance-value detector 14 and the potential-difference estimator 15 in the image forming apparatus shown in FIG. 2. Other components are the same as those used in the image forming apparatus shown in FIG. 2.

The potential-difference detector 72 switches the transfer bias voltage to be applied between the opposed roller 23 and the second-transfer roller 26 and subsequently detects a potential difference between the surface of the opposed roller 23 and the surface of the second-transfer roller 26 in a time series manner. For example, terminals 73 and 74 may be provided in contact with the surface of the opposed roller 23 and the surface of the second-transfer roller 26, respectively, and the potential-difference detector 72 may detect a potential difference therebetween. Alternatively, similar to the image forming apparatus shown in FIG. 2, an ammeter may be provided in a circuit that receives the transfer bias voltage, and the potential-difference detector 72 may detect a potential difference from an electric-current value.

The potential-difference detection is performed by the potential-difference detector 72 when a predetermined condition is satisfied, such as when the power of the image forming apparatus is turned on, when an image formable state is reached after a standby mode continues for a predetermined time or longer, or after an image forming operation is repeated for a predetermined number of sheets. During the detection, the intermediate transfer belt 20 and the second-transfer belt 28 are driven, and transfer bias voltage is applied between the opposed roller 23 and the second-transfer roller 26 in a state where a toner-image forming and transferring process is not performed. Then, the transfer bias voltage is switched from the first bias voltage value, which corresponds to when a toner image is to be transferred onto a recording medium, to the second bias voltage value, which corresponds to when the toner image is not to be transferred onto the intermediate transfer belt 20. After the switching, a change in the potential difference occurring between the surface of the opposed roller 23 and the surface of the second-transfer belt 28 is detected in a time-series manner.

Figure 9:
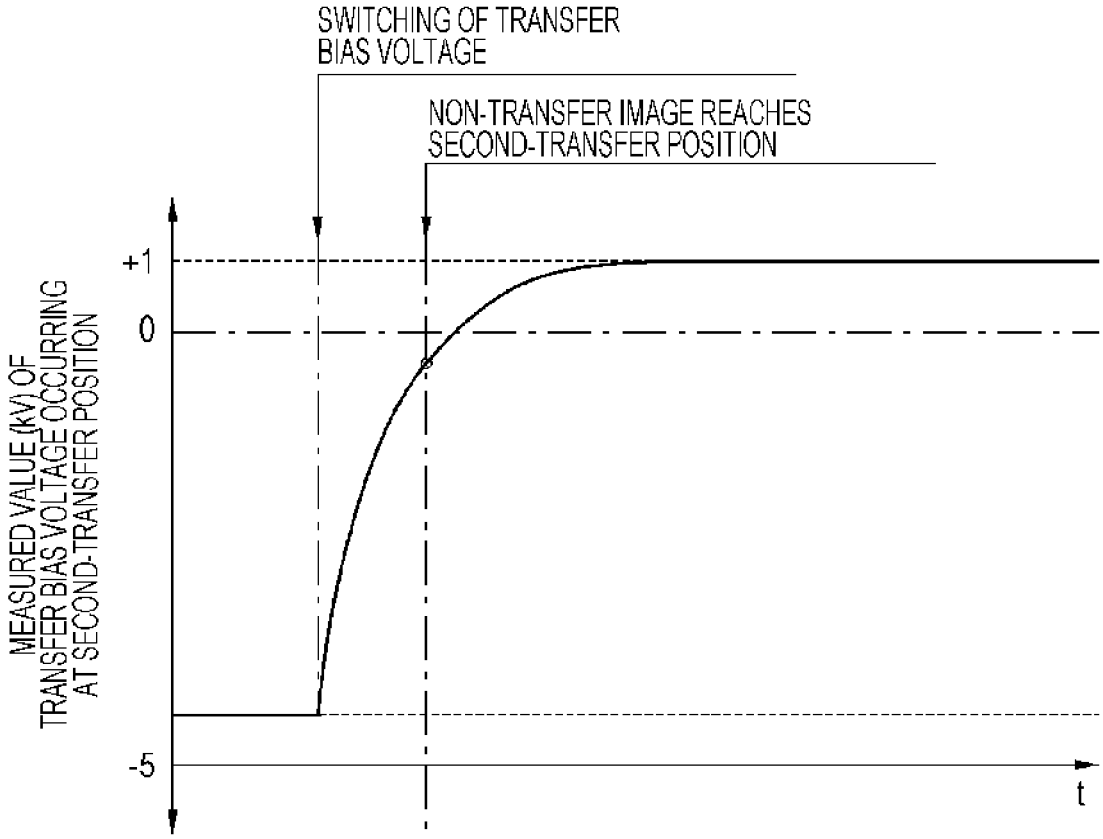
FIG. 9 illustrates a measured value of a potential difference occurring at the second-transfer position in the image forming apparatus shown in FIG. 8 and a timing at which a toner image enters the second-transfer position after switching the transfer bias voltage.

The potential difference occurring between the surface of the opposed roller 23 and the surface of the second-transfer roller 26 is detected as shown in FIG. 9. After the first bias voltage value is switched to the second bias voltage value in the power supply device 40, the potential difference changes on the basis of the time constant and becomes substantially stable upon reaching the second bias voltage value. The detection value of the potential difference is stored into the storage unit 18.

Subsequently, an image forming operation commences, and the transfer image 51 held on the intermediate transfer belt 20 is transported to the second-transfer position 30 where the transfer image 51 is transferred onto the recording medium in a state where the first bias voltage value is applied. Then, after images are formed and transferred onto multiple sheets of recording media, the transfer bias voltage is switched from the first bias voltage value to the second bias voltage value when the non-transfer image 52 held on the intermediate transfer belt 20 reaches the second-transfer position 30. In this case, after the transfer bias voltage is switched in the power supply device 40 while the intermediate transfer belt 20 moves at high speed, even if the non-transfer image 52 reaches the second-transfer position 30 in a state where the potential difference between the surface of the opposed roller 23 and the surface of the second-transfer roller 26 is not stable, as shown in FIG. 9, a potential difference corresponding to when the non-transfer image 52 reaches the second-transfer position 30 may be estimated from the timing at which the non-transfer image 52 reaches the second-transfer position 30 and the detection value of the potential difference, which changes after switching the transfer bias voltage, between the surface of the opposed roller 23 and the surface of the second-transfer roller 26. The transfer-toner-amount calculator 16 calculates an estimated amount of toner to be transferred onto the second-transfer belt 28 on the basis of the estimated potential-difference value and information related to the non-transfer image 52. Then, the cleaning-bias controller 17 determines a cleaning bias voltage value suitable for removing the calculated transfer-toner amount on the basis of the calculated transfer-toner amount and cleaning bias voltage values stored in the storage unit 18 in correspondence with the transfer-toner amount and performs control for applying the cleaning bias voltage value to the first cleaning member 31.

Accordingly, before forming the transfer image 51 to be transferred onto the recording medium, a potential difference occurring at the second-transfer position 30 at the time of switching the transfer bias voltage is actually detected. Based on this detection value, the cleaning bias voltage value to be applied to the first cleaning member 31 is controlled, so that the back face of the recording medium may be prevented from becoming dirty due to the toner of the non-transfer image 52 becoming transferred onto the second-transfer belt 28.

Furthermore, in this exemplary embodiment, the switching of modes is also possible, as described above. The modes include the bias control mode, in which the cleaning bias voltage value is controlled, and the constant bias mode, in which the potential difference at the second-transfer position 30 is not detected after switching the transfer bias voltage and the control of the cleaning bias voltage value in correspondence with the amount of toner on the second-transfer belt 28 is not performed.

The image forming apparatus is not limited to those described in the above exemplary embodiments; alternative exemplary embodiments are permissible within the scope of the invention.

For example, in each of the above exemplary embodiments, toner images formed on the photoconductor drums 1 are first-transferred onto the intermediate transfer belt 20, and the toner images of multiple colors superposed on the intermediate transfer belt 20 are second-transferred onto a recording medium at the second-transfer position 30. Thus, the intermediate transfer belt 20 functions as an image bearing member according to an exemplary embodiment of the present invention. Alternatively, the toner images may be transferred onto the recording medium directly from the photoconductor drums 1, so that the photoconductor drums 1 may function as image bearing members according to an exemplary embodiment of the present invention.

Furthermore, in each of the exemplary embodiments described above, the transfer member is constituted of the second-transfer roller 26, the auxiliary roller 27, and the second-transfer belt 28. Alternatively, the transfer member may be constituted of a roller-shaped component or may have a different configuration.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image bearing member configured to bear a toner image;

a transfer member whose rotatable endless peripheral surface is disposed facing the image bearing member, wherein the transfer member is configured to nip a recording medium together with the image bearing member and to allow the recording medium to pass between the transfer member and the image bearing member;

a transfer-bias applying unit configured to apply a transfer bias voltage so that an electric field for transferring the toner image is generated between the transfer member and the image bearing member;

a cleaning member that is disposed in contact with the peripheral surface of the transfer member and that is configured to remove toner adhered to the peripheral surface of the transfer member;

a cleaning-bias applying unit configured to apply a cleaning bias voltage between the cleaning member and the transfer member;

a transfer-toner-amount estimating unit configured to estimate an amount of toner to be transferred from the image bearing member to the transfer member during a period when the recording medium does not pass between the image bearing member and the transfer member; and a cleaning-bias controller configured to adjust a magnitude of the cleaning bias voltage to be applied by the cleaning-bias applying unit in response to the amount of toner estimated by the transfer-toner-amount estimating unit.

2. The image forming apparatus according to claim 1, further comprising a bias switching unit configured to switch the transfer bias voltage between a first bias voltage value corresponding to when the toner image on the image bearing member is to be transferred onto the recording medium and a second bias voltage value corresponding to when the toner image on the image bearing member is not to be transferred, and wherein the transfer-toner-amount estimating unit is configured to, after the transfer bias voltage is switched from the first bias voltage value to the second bias voltage value by the bias switching unit, estimate the amount of toner to be transferred onto the transfer member on the basis of a potential difference occurring between the image bearing member and the transfer member when a non-transfer image, which is not to be transferred onto the recording medium from the image bearing member, reaches a transfer position where the image bearing member and the transfer member face each other.

3. The image forming apparatus according to claim 2, wherein the transfer-toner-amount estimating unit has a resistance-value measuring unit configured to measure a resistance value between the image bearing member and the transfer member before the toner image is transferred at the transfer position, and wherein the potential difference occurring between the image bearing member and the transfer member when the non-transfer image reaches the transfer position is estimated by using data preliminarily stored in a memory in association with the resistance value between the image bearing member and the transfer member and the resistance value measured by the resistance-value measuring unit.

4. The image forming apparatus according to claim 3, wherein the data stored in the memory includes a time constant associated with the resistance value and corresponding to when the transfer bias voltage is switched, and wherein the potential difference occurring between the image bearing member and the transfer member when the non-transfer image reaches the transfer position is estimated on the basis of the time constant corresponding to the resistance value measured by the resistance-value measuring unit and a timing at which the non-transfer image reaches the transfer position.

5. The image forming apparatus according to claim 2, wherein the transfer-toner-amount estimating unit has a potential-difference detecting unit configured to detect the potential difference occurring between the image bearing member and the transfer member, wherein the bias switching unit is configured to switch the transfer bias voltage from the first bias voltage to the second bias voltage before the toner image is transferred at the transfer position, and a change in the potential difference occurring between the image bearing member and the transfer member after switching the transfer bias voltage is recorded in a time-series manner, and wherein the potential difference occurring between the image bearing member and the transfer member when the non-transfer image reaches the transfer position is estimated on the basis of a detection value obtained by the potential-difference detecting unit and a timing at which the non-transfer image reaches the transfer position.

6. The image forming apparatus according to claim 1, further comprising a mode switching unit configured to switch between a bias control mode in which the cleaning bias voltage is controlled by the cleaning-bias controller on the basis of the amount of toner estimated by the transfer-toner-amount estimating unit and a constant bias mode in which a predetermined bias voltage value is applied between the cleaning member and the transfer member.

7. The image forming apparatus according to claim 1, wherein the cleaning-bias controller is configured to adjust the magnitude of the cleaning bias voltage to be a larger value in response to a larger amount of toner being estimated by the transfer-toner-amount estimating unit.

8. The image forming apparatus according to claim 7, wherein the cleaning-bias controller is configured to adjust the magnitude of the cleaning bias voltage to be a smaller value in response to a smaller amount of toner being estimated by the transfer-toner-amount estimating unit.

9. The image forming apparatus according to claim 1, wherein the cleaning-bias controller is configured to adjust the magnitude of the cleaning bias voltage to be applied by the cleaning-bias applying unit in response to feedback from the transfer-toner-amount estimating unit regarding the estimated amount of toner to be transferred.

10. An image forming apparatus comprising:

an image bearing member configured to bear a toner image;

a transfer member whose rotatable endless peripheral surface is disposed facing the image bearing member, wherein the transfer member is configured to nip a recording medium together with the image bearing member and to allow the recording medium to pass between the transfer member and the image bearing member;

a transfer-bias applying unit configured to apply a transfer bias voltage so that an electric field for transferring the toner image is generated between the transfer member and the image bearing member;

a cleaning member that is disposed in contact with the peripheral surface of the transfer member and that is configured to remove toner adhered to the peripheral surface of the transfer member;

a cleaning-bias applying unit configured to apply a cleaning bias voltage between the cleaning member and the transfer member;

a transfer-toner-amount estimating unit configured to estimate an amount of toner to be transferred from the image bearing member to the transfer member during a period when the recording medium does not pass between the image bearing member and the transfer member;

a cleaning-bias controller configured to control the cleaning bias voltage to be applied by the cleaning-bias applying unit in correspondence with the amount of toner estimated by the transfer-toner-amount estimating unit; and a bias switching unit configured to switch the transfer bias voltage between a first bias voltage value corresponding to when the toner image on the image bearing member is to be transferred onto the recording medium and a second bias voltage value corresponding to when the toner image on the image bearing member is not to be transferred, wherein the transfer-toner-amount estimating unit is configured to, after the transfer bias voltage is switched from the first bias voltage value to the second bias voltage value by the bias switching unit, estimate the amount of toner to be transferred onto the transfer member on the basis of a potential difference occurring between the image bearing member and the transfer member when a non-transfer image, which is not to be transferred onto the recording medium from the image bearing member, reaches a transfer position where the image bearing member and the transfer member face each other.

11. An image forming apparatus comprising:

an image bearing member configured to bear a toner image;

a transfer member whose rotatable endless peripheral surface is disposed facing the image bearing member, wherein the transfer member is configured to nip a recording medium together with the image bearing member and to allow the recording medium to pass between the transfer member and the image bearing member;

a transfer-bias applying unit configured to apply a transfer bias voltage so that an electric field for transferring the toner image is generated between the transfer member and the image bearing member;

a cleaning member that is disposed in contact with the peripheral surface of the transfer member and that is configured to remove toner adhered to the peripheral surface of the transfer member;

a cleaning-bias applying unit configured to apply a cleaning bias voltage between the cleaning member and the transfer member;

a transfer-toner-amount estimating unit configured to estimate an amount of toner to be transferred from the image bearing member to the transfer member during a period when the recording medium does not pass between the image bearing member and the transfer member;

a cleaning-bias controller configured to control the cleaning bias voltage to be applied by the cleaning-bias applying unit in correspondence with the amount of toner estimated by the transfer-toner-amount estimating unit; and a mode switching unit configured to switch between a bias control mode in which the cleaning bias voltage is controlled by the cleaning-bias controller on the basis of the amount of toner estimated by the transfer-toner-amount estimating unit and a constant bias mode in which a predetermined bias voltage value is applied between the cleaning member and the transfer member.

* * * * *